United States Patent [19]

Lowery et al.

[11] 4,036,450

[45] July 19, 1977

[54] METHOD AND APPARATUS FOR PAYING OUT WIRE

[75] Inventors: James O. Lowery, Ranburne, Ala.; Jimmy D. Blackmon, Carrollton, Ga.; W. Carl Jones, Carrollton, Ga.; Lee K. Brewton, Carrollton, Ga.

[73] Assignee: Southwire Company, Carrollton, Ga.

[21] Appl. No.: 643,917

[22] Filed: Dec. 23, 1975

[51] Int. Cl.[2] ..... B65H 49/00

[52] U.S. Cl. ..... 242/129

[58] Field of Search ..... 242/129, 129.62, 47, 242/47.01; 57/106, 108

[56] References Cited

U.S. PATENT DOCUMENTS

| | | | |
|---|---|---|---|
| 864,342 | 8/1907 | Smith | 242/128 |
| 2,858,088 | 10/1958 | Bookout | 242/129 |
| 2,930,541 | 3/1960 | Crum | 242/129 |
| 3,874,611 | 4/1975 | Slasor et al. | 242/129 |

*Primary Examiner*—Leonard D. Christian

*Attorney, Agent, or Firm*—Van C. Wilks; Herbert M. Hanegan; Stanley L. Tate

[57] ABSTRACT

This disclosure relates to a method and apparatus for paying-out wire from a horizontally disposed coil. The wire is disposed in a stemless wire pack container and payed-out therefrom substantially vertically overhead. The wire is guided about a sheave disposed a substantial distance above the stemless pack at a point disposed on the vertical axis of the coil for substantially reducing the magnitude of the inward component of force acting along the wire as it is withdrawn from the container. A substantially frictionless plastic dish-shaped element rides downwardly and is freely movable on the top of the coil as the wire is payed-out therefrom. The dish-shaped element functions to break up each loop of wire from the remainder of the coil as it is payed-out therefrom without exerting any substantial friction force thereagainst which would tend to mar the finish of the wire.

4 Claims, 5 Drawing Figures

METHOD AND APPARATUS FOR PAYING OUT WIRE

BACKGROUND OF THE INVENTION

This invention relates to the wire-handling art, and more particularly to a method and apparatus for paying-out wire from a horizontally-disposed coil of wire.

It is now conventional in the wire-handling art to take up wire exiting a wire drawing machine or a wire insulating line into a basket which is typically termed a "stem pack." The basket is so named because it comprises an outer cage-like frame having a central core or stem disposed therein around which sucessive loops or convolutions of the wire are wound as it is loaded into the basket. The central core or stem functions to assure an orderly loading of the wire into the basket, as well as an orderly withdrawal of successive loops of the wire from the stem pack without tangling or kinking during subsequent processing. A typical stem pack is disclosed in U.S. Pat. No. 3,362,654, issued Jan. 9, 1968 to H. L. Kitselman.

Not only do the stem packs provide a convenient receptacle for the wire as it is delivered from the coiling devices of wire drawing or insulating apparatus, but they also provide convenient means for storing the wire and transporting the same to other locations in the manufacturing plant where the wire may be further processed, such as to be stranded with other wires to manufacture cable, or brought together with other wires, fillers, and separators and passed through a jacketing extruder wherein a plastic coating compound can be continuously applied thereto in the form of a non-metallic sheath cable.

When the stem packs are utilized as pay-out containers during subsequent processing of the wire, they are disposed with their longitudinal axes extending vertically and the wire is withdrawn overhead therefrom. During this operation the stem facilitates the overhead vertical withdrawal by providing a center guide within the horizontally disposed coil which assures an orderly withdrawal of successive loops of the wire from the coil without tangling or kinking thereof. While such apparatus is satisfactory for relatively low speed withdrawal operations, it has been found that during high speed operation, facilitated by improved production techniques of cable manufacture, the surface quality of the wire, both bare and insulated, can be damaged by coming in contact with the central stems of these conventional stem pack containers. Such damage consists of abrasion, nicks, and general surface deterioration.

SUMMARY OF THE INVENTION

In view of the foregoing, it should be apparent that there is a need in the wire-handling art for a method and apparatus for facilitating high-speed withdrawal of wire from horizontally disposed coils which prevents tangling of the wire while at the same time prevents damage to the surface of the wire. Accordingly, it is a primary object of this invention to provide a method of paying-out wire from a horizontally disposed coil of wire which comprises disposing the wire in a stemless wire pack container which confines the coil against radial outward movement but does not restrain radial inward movement thereof.

Another object of this invention, therefore, is to provide a stemless wire pack container which can be utilized in the aforementioned method, as well as apparatus for overhead withdrawal of wire therefrom which substantially eliminates tangling and kinking of the wire.

Since providing a stemless wire pack container, in accomplishing the foregoing objects of this invention, eliminates the central core which was used by the prior art to assure the orderly withdrawal of successive loops, it is a further object of this invention to provide a method and apparatus for withdrawing wire from a stemless pack which substantially reduces forces acting on the wire which tend to cause radial inward movement of the loops as they are being withdrawn, thereby resulting in more than a single loop being withdrawn at a time.

A further object of this invention is to provide a method and apparatus for withdrawing wire from a horizontally disposed coil which includes providing a substantially frictionless guide member adapted to rest on the top of the coil and ride downwardly thereon as the wire is being withdrawn, the guide member functioning to break up loops of wire as they are withdrawn thereby preventing kinking and tangling of the wire while presenting insufficient friction to damage the surface thereof.

With the above and other objects in view that may become more apparent hereinafter, the nature of the invention may be more clearly understood by reference to the several views illustrated in the attached drawings, the following detailed description thereof and the appended claimed subject matter.

DETAILED DESCRIPTION OF THE PREFERRED EMBODIMENT

Figure 3:
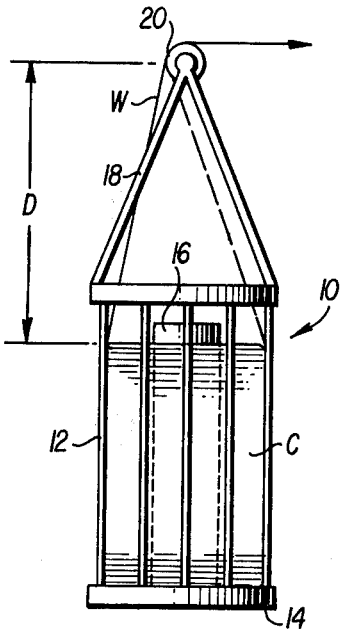
FIG. 3 (PRIOR ART)
FIG. 3 is an elevation view of a prior art stem pack container, illustrating the central core or stem, and further illustrating a guide sheave which is formed integrally with the stem pack.

Referring now to the drawings in detail, there is illustrated in FIG. 3 a prior art stem pack, designated generally by the numeral 10, which contains a horizontally-disposed coil of wire C. The stem pack 10 includes a basket-like cage portion defined by a plurality of upstanding metal rods 12 and a base portion 14. A central core or stem 16 extends upwardly from the base portion 14 to a point near the top of the basket and serves as a central core for the coil of wire C disposed therein. The prior art stem pack 10 further includes a superstructure composed of a plurality of converging arms 18 upon which a sheave 20 is mounted. The sheave 20 serves as a guide for wire withdrawn from the coil C.

Figure 4:
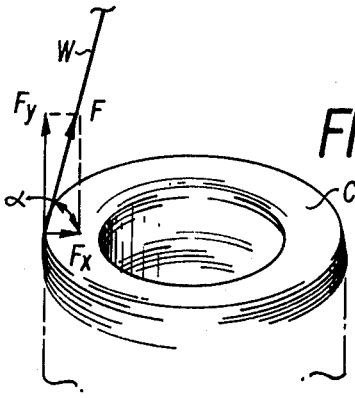
FIG. 4 is a perspective view of a coil of wire wherein the wire is being withdrawn overhead therefrom, and diagrammatically illustrates a vector diagram representing the forces acting on the wire as it is being withdrawn.

Since the sheave 20, is, in effect, part of the stem pack 10, it is disposed only a short distance D above the coil C. This distance D is typically 4–5 feet. Consequently, the wire W being withdrawn from the coil C will form an acute angle $\alpha$ with a horizontal plane as seen most clearly in FIG. 4. Thus, the force F acting along the wire W will have a radial inward component $F_x$ the magnitude of which is inversely proportional to the size of the angle $\alpha$. It has been found in accordance with this invention that it is this radial inward force $F_x$ which causes each loop of wire being withdrawn from the coil C to tend to slide inwardly under the next loop in the coil, thereby effecting the withdrawal of more than a single loop at a time. It has been further determined in accordance with this invention that it is this multiple withdrawing of loops which tends to cause tangles and kinks in the wire. This condition is particularly exacerbated when the wire W is being withdrawn at high speeds. Moreover, the inwardly directed force $F_x$ causes the wire W to bear against the stem 16 of the prior art stem pack 10, thus causing damage to the wire.

Figure 1:
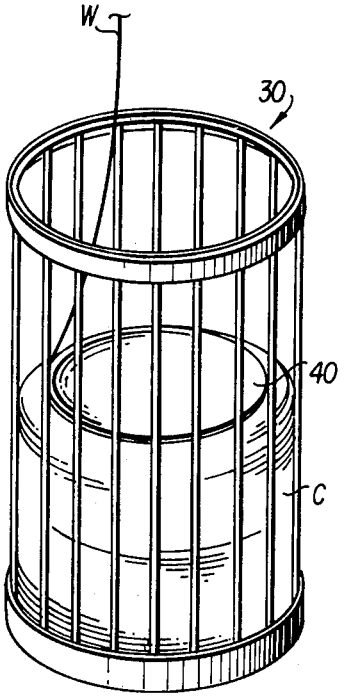
FIG. 1 is a perspective view of a stemless wire pack in accordance with this invention, and illustrates a coil of wire horizontally disposed therein and having a dish-shaped guide member disposed on the top thereof.

A stemless pack, provided in accordance with this invention, is illustrated in FIG. 1 and designated generally by the numeral 30. The stemless pack 30 is similar to the stem pack 10 of the prior art, except that is does not include the central stem or core 16, nor is it provided with an integrally-mounted sheave.

Figure 2:
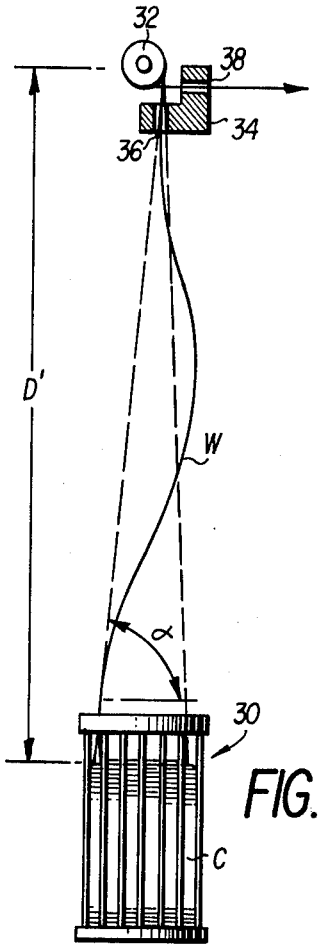
FIG. 2 is a schematic elevation view of apparatus for withdrawing wire from the stemless container of this invention, and illustrates a guide sheave disposed a substantial distance above the coil along the longitudinal axis thereof, and guide members which guide the wire about approximately 270° of the periphery of the sheave.

As seen in FIG. 2, the wire W is withdrawn from the stemless pack 30 over a guide sheave 32 which is mounted a substantial distance D′ above the coil C. Accordingly, the angle $\alpha$ is substantially increased as compared with the angle $\alpha$ in prior art devices wherein the sheaves are closely mounted in relation to the top of the coil C. It should be further apparent, that the inwardly-directed force component $F_x$ will be correspondingly decreased, thus inhibiting the tendency of the wire to tangle as it is withdrawn from the coil C.

It has been found in accordance with this invention that the ratio of the distance D′ to the diameter of the coil C should be preferably at least 5:1. This ratio is, of course, a function of, among other things, the thickness and flexibility of the wire, the coefficient of friction of its surface (bare or insulated), as well as the speed of withdrawal. The aforementioned preferred ratio of 5:1 is thus based on wire sizes corresponding to numbers AWG 10, 12 and 14, PVC insulation coated and withdrawal speeds of approximately 750 feet per minute.

During high speed withdrawal, the convolutions of wire W being withdrawn from the coil C tend to whip about as seen in FIG. 2. Accordingly, there is a tendency for the wire to jump out of the grooved periphery of the overhead sheave. In order to prevent this occurrence, there is provided in accordance with this invention a guide block 34 having an inlet bore 36 and an outlet bore 38 for guiding the wire onto and off of, respectively, the periphery of the sheave 32. The bores 36 and 38 are contained in different vertical planes, thereby permitting the wire to travel in the counterclockwise direction about the sheave 32 so as to provide contact therewith over about 270° of the sheave 32. Accordingly, the tendency of the wire W to jump off of the sheave 32 is mitigated.

Figure 5:
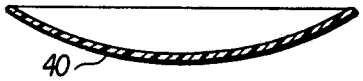
FIG. 5 is an enlarged vertical sectional view taken through the dish-shaped guide member depicted in FIG. 1.

In order to further facilitate the orderly withdrawal of the wire W from the stemless pack 30, there is provided a dish-like guide member 40, as seen in FIGS. 1 and 5, which is adapted to rest on the top of the coil C and to ride downwardly therewith as the wire W is withdrawn therefrom. The guide element 40 is preferably made of a very smooth and light-weight plastic material which presents a substantially frictionless resistance to the wire W. Thus, the guide element 40 will function to break up and separate each loop being withdrawn from the remainder of the coil C, but at the same time is freely movable thereon and provides substantially no resistance to the wire W so as to prevent marring the surface thereof. It is to be understood, however, that the guide element 40 is merely an optional feature of this invention, and that orderly withdrawal of each loop of wire W should be obtainable, even at high speeds, if the sheave 32 is positioned a sufficient distance above the coil C.

In view of the foregoing, it should be apparent that there is provided in accordance with this invention a novel method and apparatus for withdrawing wire from a horizontally disposed coil, utilizing a stemless wire pack container thereby preventing damage and abrasion to the surface of the wire, while still maintaining an orderly withdrawal of each successsive loop so as to prevent kinking and tangling thereof at high withdrawal speeds.

Although only a preferred embodiment of the invention has been specifically illustrated and described herein, it is to be understood that minor modifications could be made therein without departing from the spirit of the invention as defined in the appended claims.

What is claimed is:

1. Apparatus for paying-out wire from a horizontally disposed coil of wire of given diameter comprising a stemless wire pack container for holding the coil of wire, means for withdrawing wire overhead from said stemless container, said withdrawing means including guide means disposed a substantial distance above said container at a point disposed on the vertical axis of said coil for substantially reducing the magnitude of the inward component of force acting along the wire as it is withdrawn from said container, said distance being such that the ratio of the distance to the diameter of the coil is at least 5:1, said withdrawing means including a rotatable sheave having a groove formed in the periphery thereof, first means for guiding the wire onto the sheave and second means for guiding the wire off the sheave, said first and second guiding means being arranged with respect to said sheave to assure that the wire contacts said sheave over approximately 270° of the periphery thereof.

2. Apparatus as defined in claim 1 wherein said first and second guiding means comprises a guide block having a vertically disposed inlet bore and a horizontally disposed outlet bore, the axis of said inlet bore being substantially coincident with a vertical tangent at one side of said sheave and the axis of said outlet bore being substantially coincident with a horizontal tangent at the bottom of said sheave, and wherein the axes of said bores are in different vertical planes whereby said wire may be guided through said inlet bore onto one side of said sheave, around the top and the other side of said sheave, and off the bottom of said sheave through said outlet bore.

3. Apparatus for paying-out wire from a horizontally disposed coil of wire of given diameter comprising a stemless wire pack container for holding the coil of wire, means for withdrawing wire overhead from said stemless container, said withdrawing means including guide means disposed a substantial distance above said container at a point disposed on the vertical axis of said coil for substantially reducing the magnitude of the inward component of force acting along the wire as it is withdrawn from said container, said distance being such that the ratio of the distance to the diameter of the coil is at least 5:1, and including a substantially frictionless guide member freely movable on the top of the coil for breaking up each loop of wire from the remainder of the coil as it is payed-out therefrom, said guide member comprising a dish-shaped element adapted to rest on the top of the coil of wire and ride downwardly thereon as the wire is payed-out.

4. Method of paying out wire from a horizontally disposed coil of wire of given diameter, said coil consisting of a plurality of individual loops layed on top of one another about a vertical axis in a stemless wire pack container, the method comprising withdrawing the wire from the container substantially overhead to a point on said axis which results in a force along the wire having a radially inward component which tends to cause the loop being withdrawn to tend to slide inwardly under the next loop thus resulting in a tangle, the improvement comprising increasing the distance between the coil and said point such that the ratio of the distance to the diameter of the coil is at least 5:1 whereby the magnitude of said inward component is reduced to a value which substantially prevents the loop being withdrawn from sliding under the next loop and breaking up each loop of wire from the remainder of the coil as it is payed-out therefrom by disposing a freely movable guide member on the coil and permitting it to ride coaxially downwardly thereon as the wire is payed-out.

* * * * *